US010260242B2

(12) United States Patent
St-Laurent

(10) Patent No.: US 10,260,242 B2
(45) Date of Patent: Apr. 16, 2019

(54) FLOOR COVERING WITH REPLACEABLE FLOORBOARDS

(71) Applicant: André St-Laurent, Laval (CA)

(72) Inventor: André St-Laurent, Laval (CA)

( * ) Notice: Subject to any disclaimer, the term of this patent is extended or adjusted under 35 U.S.C. 154(b) by 0 days.

(21) Appl. No.: 15/632,265

(22) Filed: Jun. 23, 2017

(65) Prior Publication Data

US 2017/0292277 A1 Oct. 12, 2017

Related U.S. Application Data

(62) Division of application No. 14/682,407, filed on Apr. 9, 2015, now abandoned.

(60) Provisional application No. 61/977,601, filed on Apr. 9, 2014.

(51) Int. Cl.
*E04F 15/02* (2006.01)

(52) U.S. Cl.
CPC .. *E04F 15/02038* (2013.01); *E04F 15/02044* (2013.01); *E04F 2201/0138* (2013.01); *E04F 2201/023* (2013.01); *E04F 2201/042* (2013.01)

(58) Field of Classification Search
CPC ..... E04F 15/02038; E04F 2201/042; E04F 2201/023; E04F 2201/0138
See application file for complete search history.

(56) References Cited

U.S. PATENT DOCUMENTS 6,134,854 A * 10/2000 Stanchfield ..... E04F 11/16 52/403.1
2004/0074189 A1* 4/2004 Deschenes ..... B27M 3/0053 52/589.1
2009/0186192 A1* 7/2009 Gribble ..... B63B 3/48 428/151
2009/0193741 A1* 8/2009 Cappelle ..... E04F 15/02 52/309.1
2010/0031594 A1* 2/2010 Liu ..... E04F 15/02 52/403.1
2013/0305650 A1* 11/2013 Liu ..... E04F 15/02038 52/592.1
2017/0247890 A1* 8/2017 Bladh ..... E04F 15/105
2018/0044924 A1* 2/2018 Flynn ..... E04F 15/02183

* cited by examiner

*Primary Examiner* — Gisele D Ford
(74) *Attorney, Agent, or Firm* — PRAXIS

(57) ABSTRACT

A floor covering comprises at least first and second floorboards. Each floorboard respectively defines opposite longitudinal ends, an exposed outer surface and an opposite underside surface for engaging a subfloor, and comprises mating structures at each lateral side thereof. The first and second floorboards are configured to be adjacently assembled in a side-to-side arrangement with the mating structure of one of the lateral sides of the first floorboard vertically and removably mating with the mating structure of one of the lateral sides of the second floorboard. The floor covering includes at least one clip for being fastened to the subfloor and comprises mating structures at each lateral side thereof for vertically and removably receiving the respective mating structures first and second floorboards at each lateral side thereof.

8 Claims, 5 Drawing Sheets

FLOOR COVERING WITH REPLACEABLE FLOORBOARDS

CROSS-REFERENCE TO RELATED APPLICATIONS

This application claims priority on U.S. Provisional Patent Application No. 61/977,601 filed on Apr. 9, 2014 and is a divisional application of U.S. patent application Ser. No. 14/682,407 filed on Apr. 9, 2015, both of which are incorporated herein by reference in their entirety.

TECHNICAL FIELD

The present disclosure relates to flooring. More particularly, but not exclusively, the present disclosure relates a floor covering with replaceable floorboards.

BACKGROUND

Floor covering is any finish material applied over a floor structure to provide a walking surface. Many different species of wood are fabricated into wood flooring in the forms of floorboards such as in planks and parquets. The floorboards can be made from hardwood or laminates including plywood or medium density fiberboard ("MDF") core with a plastic laminate top layer. HDF laminate consists of high density fiberboard topped by one or more layers of decorative paper and a transparent protective layer. The floorboards are positioned over the subfloor and assembled together to provide a permanent floor covering. Thus, when a given floorboard is damaged, the whole floor covering or at least a section of the floor covering needs to be removed and redone

OBJECTS

An object of the present disclosure is to provide a floor covering with replaceable floorboards.

An object of the present disclosure is to provide a kit for a floor covering with replaceable floorboards.

An object of the present disclosure is to provide a replaceable floorboard for a floor covering.

An object of the present disclosure is to provide a replaceable floorboard for a floor covering.

An object of the present disclosure is to provide a method of making a floor covering with replaceable floorboards.

SUMMARY

In accordance with an aspect of the disclosure there is provided a floor covering comprising: at least a first floorboard defining opposite longitudinal ends, an exposed outer surface and an opposite underside surface for engaging a subfloor, the first floorboard comprising mating structures at each lateral side thereof; and at least a second floorboard defining opposite longitudinal ends, an exposed outer surface and an opposite underside surface for engaging a subfloor, the second floorboard comprising mating structures at each lateral side thereof, wherein the first and second floorboards are configured to be adjacently assembled in a side-to-side arrangement with the mating structure of one of the lateral sides of the first floorboard vertically and removably mating with the mating structure of one of the lateral sides of the second floorboard.

In an embodiment, the one of the first and second floorboards is fastened to the subfloor.

In accordance with an aspect of the disclosure there is provided a floor covering comprising: at least a first floorboard defining opposite longitudinal ends, an exposed outer surface and an opposite underside surface for engaging a subfloor, the first floorboard comprising mating structures therefrom at each lateral side thereof; at least a second floorboard defining opposite longitudinal ends, an exposed outer surface and an opposite underside surface for engaging a subfloor, the second floorboard comprising mating structures at each lateral side thereof; and at least one clip for being fastened to the subfloor and comprising mating structures at each lateral side thereof, wherein the first and second floorboards are configured to be adjacently assembled in a side-to-side arrangement with the mating structure of one of the lateral sides of the first floorboard vertically and removably mating with the mating structure of one of the lateral sides of the clip and with the mating structure of one of the lateral sides of the second floorboard vertically and removably mating with the mating structure of another one of the lateral sides of the clip.

In accordance with an aspect of the disclosure there is provided a kit for making a floorboard, the kit comprising: a first floorboard defining opposite longitudinal ends, an exposed outer surface and an opposite underside surface for engaging a subfloor, the first floorboard comprising mating structures at each lateral side thereof; and at least a second floorboard defining opposite longitudinal ends, an exposed outer surface and an opposite underside surface for engaging a subfloor, the second floorboard comprising mating structures at each lateral side thereof, wherein the first and second floorboards are configured to be adjacently assembled in a side-to-side arrangement with the mating structure of one of the lateral sides of the first floorboard vertically and removably mating with the mating structure of one of the lateral sides of the second floorboard.

In accordance with an aspect of the disclosure there is provided a kit for making a floorboard, the kit comprising: at least a first floorboard defining opposite longitudinal ends, an exposed outer surface and an opposite underside surface for engaging a subfloor, the first floorboard comprising mating structures therefrom at each lateral side thereof; at least at least a second floorboard defining opposite longitudinal ends, an exposed outer surface and an opposite underside surface for engaging a subfloor, the second floorboard comprising mating structures at each lateral side thereof, at least one clip for being fastened to the subfloor and comprising mating structures at each lateral side thereof, wherein the first and second floorboards are configured to be adjacently assembled in a side-to-side arrangement with the mating structure of one of the lateral sides of the first floorboard vertically and removably mating with the mating structure of one of the lateral sides of the clip and with the mating structure of one of the lateral sides of the second floorboard vertically and removably mating with the mating structure of another one of the lateral sides of the clip.

In accordance with an aspect of the disclosure there is provided a floorboard for being assembled with at least one other floorboard in an adjacent side-to-side arrangement in order to provide a floor covering, the at least one other floorboard defining opposite longitudinal ends, an exposed outer surface and an opposite underside surface for engaging a subfloor, and comprising mating structures at each lateral side thereof, the floorboard comprising: opposite longitudinal ends, an exposed outer surface and an opposite underside surface for engaging a subfloor, and mating structures at each lateral side thereof, wherein the mating structure of one of the lateral sides of the floorboard is configured to vertically and removably mate with the mating structure of one of the lateral sides of the at least one other floorboard.

In accordance with an aspect of the disclosure there is provided a floorboard for being assembled with at least one clip that receives another floorboard for providing a floor covering, the at least one clip providing for being fastened to the subfloor and comprising mating structures at each lateral side thereof, the floorboard comprising: opposite longitudinal ends, an exposed outer surface and an opposite underside surface for engaging a subfloor, and mating structures at each lateral side thereof, wherein the mating structure of one of the lateral sides of the floorboard is configured to vertically and removably mate with the mating structure of one of the lateral sides of the at least one clip.

In accordance with an aspect of the disclosure there is provided a method of making a floor covering, the method comprising: providing at least a first floorboard defining opposite longitudinal ends, an exposed outer surface and an opposite underside surface for engaging a subfloor, the first floorboard comprising mating structures at each lateral side thereof; providing at least a second floorboard defining opposite longitudinal ends, an exposed outer surface and an opposite underside surface for engaging a subfloor, the second floorboard comprising mating structures at each lateral side thereof; and adjacently assembling the first and second floorboards in a side-to-side arrangement with the mating structure of one of the lateral sides of the first floorboard vertically and removably mating with the mating structure of one of the lateral sides of the second floorboard.

In accordance with an aspect of the disclosure there is provided a method of making a floor covering, the method comprising: providing at least a first floorboard defining opposite longitudinal ends, an exposed outer surface and an opposite underside surface for engaging a subfloor, the first floorboard comprising mating structures therefrom at each lateral side thereof; providing at least a second floorboard defining opposite longitudinal ends, an exposed outer surface and an opposite underside surface for engaging a subfloor, the second floorboard comprising mating structures at each lateral side thereof, providing at least one clip for being fastened to the subfloor and comprising mating structures at each lateral side thereof; fastening the clip to the subfloor; adjacently assembling the first and second floorboards on the subfloor in a side-to-side arrangement with the mating structure of one of the lateral sides of the first floorboard vertically and removably mating with the mating structure of one of the lateral sides of the clip and with the mating structure of one of the lateral sides of the second floorboard vertically and removably mating with the mating structure of another one of the lateral sides of the clip.

Other objects, advantages and features of the present disclosure will become more apparent upon reading of the following non-restrictive description of illustrative embodiments thereof, given by way of example only with reference to the accompanying drawings.

BRIEF DESCRIPTION OF THE DRAWINGS

In the appended drawings

DETAILED DESCRIPTION OF ILLUSTRATIVE EMBODIMENTS

Generally stated and in accordance with an embodiment, there is provided a floor covering comprising: at least first and second floorboards. Each floorboard respectively defines opposite longitudinal ends, an exposed outer surface and an opposite underside surface for engaging a subfloor, and comprises mating structures at each lateral side thereof. The first and second floorboards are configured to be adjacently assembled in a side-to-side arrangement with the mating structure of one of the lateral sides of the first floorboard vertically and removably mating with the mating structure of one of the lateral sides of the second floorboard. The floor covering includes at least one clip for being fastened to the subfloor and comprises mating structures at each lateral side thereof for vertically and removably receiving the respective mating structures first and second floorboards at each lateral side thereof.

With reference, to the appended Figures, non-restrictive illustrative embodiments will be herein described so as to further exemplify the disclosure only and by no means limit the scope thereof.

Figure 1:
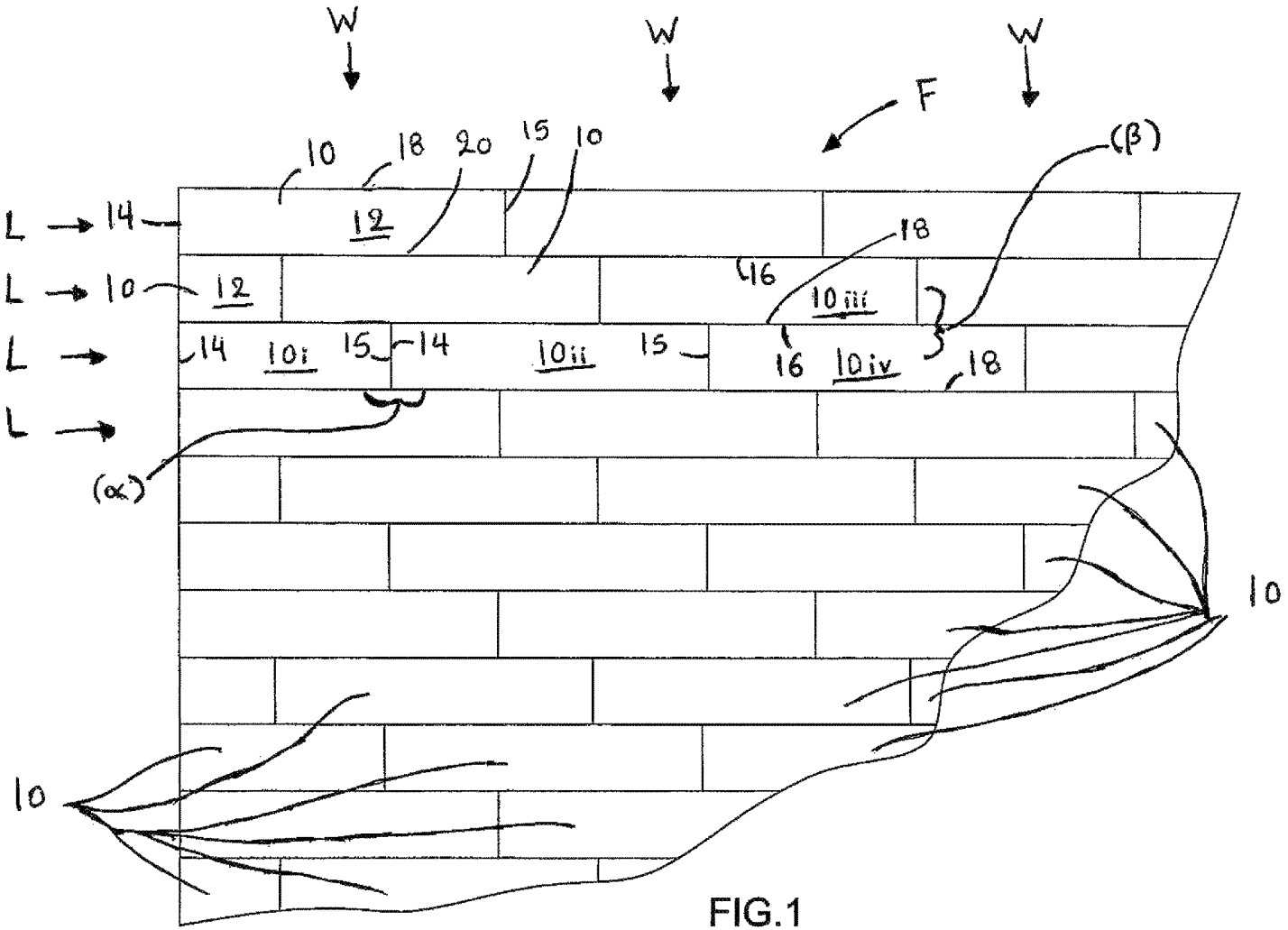
FIG. 1 is a top plan view of a floor covering in accordance with an illustrative non-limiting embodiment of the present disclosure.

FIG. 1 shows a floor covering F comprising a plurality of assembled floorboards, generally denoted 10. Each floorboard 10 includes an exposed surface 12, the assembly of the exposed floorboard surfaces S define the surface of the floor covering F. Each floorboard 10 is an elongated plank structure defining opposite first and second longitudinal ends 14 and 15, respectively and opposite first and second lateral sides, generally denoted as 18 and 20, respectively. The terms "first" and "second" are used herein only for convenience as indicative terms and thus are interchangeable.

The floorboards 10 are assembled end-to-end along floorboard length rows L and side-by-side along floorboard-width rows W. A pair (α) of adjacent floorboards, particularly denoted as 10*i* and 10*ii*, in the same row L are assembled with the second end 15 of one floorboard 10*i* of the pair (α) mating with the first end 14 of the other floorboard 10*ii* of the pair (α). A pair (β) of adjacent floorboards, particularly denoted as 10*iii* and 10*iv*, in the same row W are assembled with the second lateral side 20 of one floorboard 10*iv* of the pair (β) mating with the first lateral side 18 of the other floorboard 10*iv* of the pair (β). Due to aesthetic design considerations, the side-by-side adjacent floorboards 10 are offset with respect to one another along the rows W and as such one side 16 or 18 of a given floorboard 10 mates with at least two sides 18 or 16, respectively, of another adjacent floorboard 10.

Figures 2, 3:
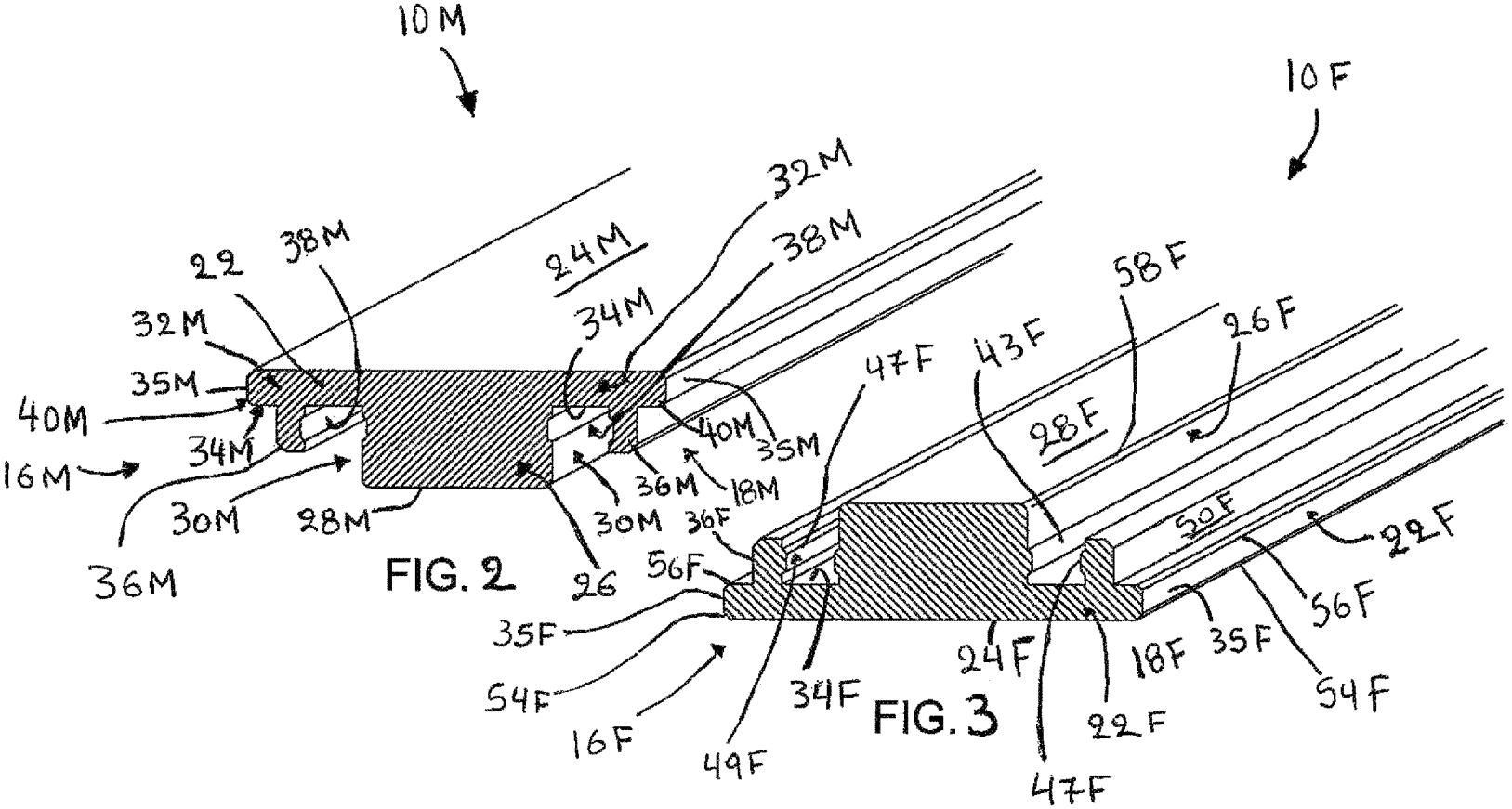
FIG. 2 is a perspective view of a one type of floorboard in accordance with an illustrative non-limiting embodiment of the present disclosure.
FIG. 3 is a perspective view of another type of floorboard in accordance with an illustrative non-limiting embodiment of the present disclosure.
Figures 4, 5:
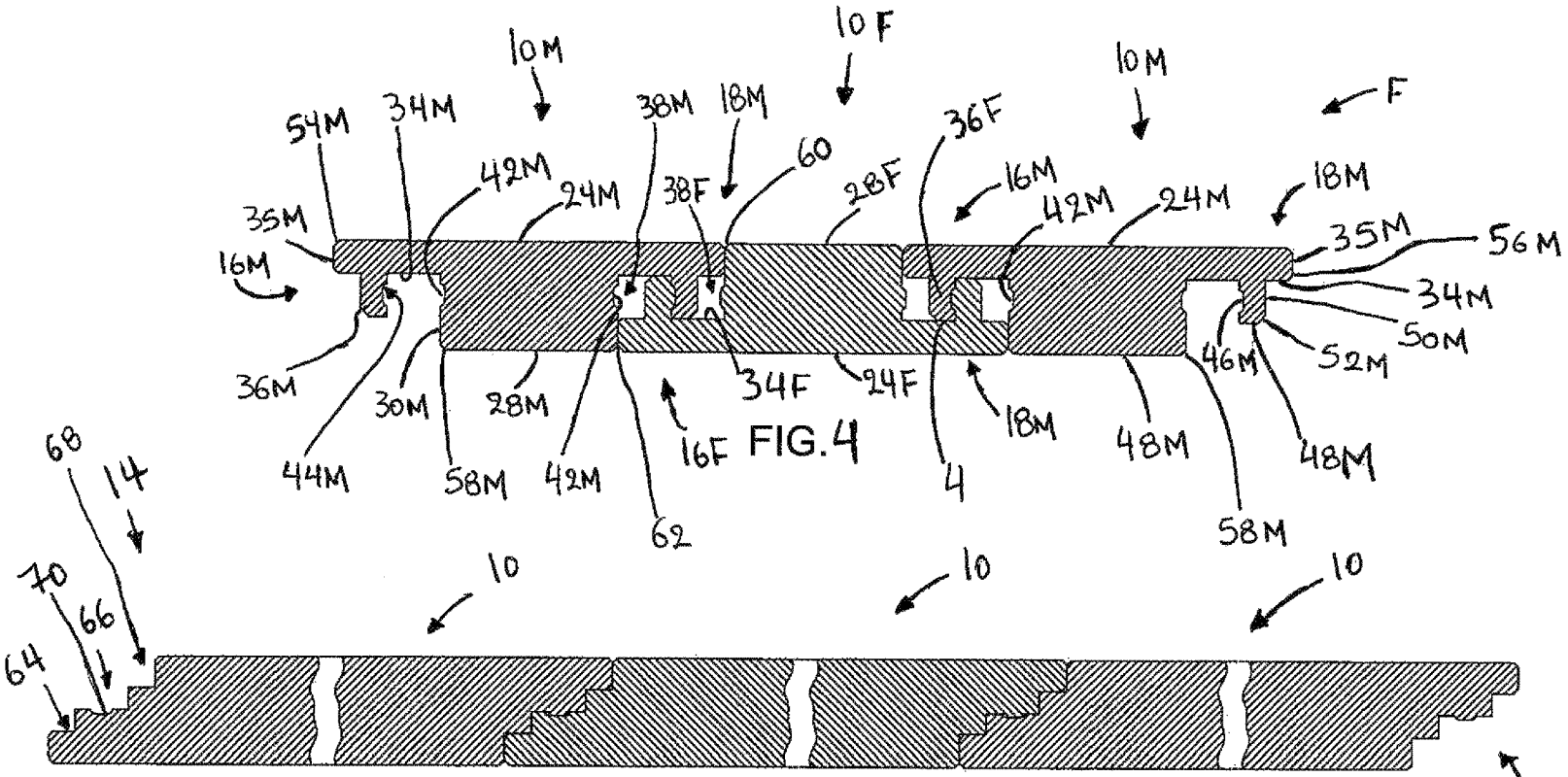
FIG. 4 is a front sectional view of the floorboards of FIGS. 2 and 3 being assembled in a side-by-side arrangement in accordance with an illustrative non-limiting embodiment of the present disclosure.
FIG. 5 is lateral side sectional view of floorboards being assembled in an end-to-end arrangement in accordance with an illustrative non-limiting embodiment of the present disclosure.
Figure 6:
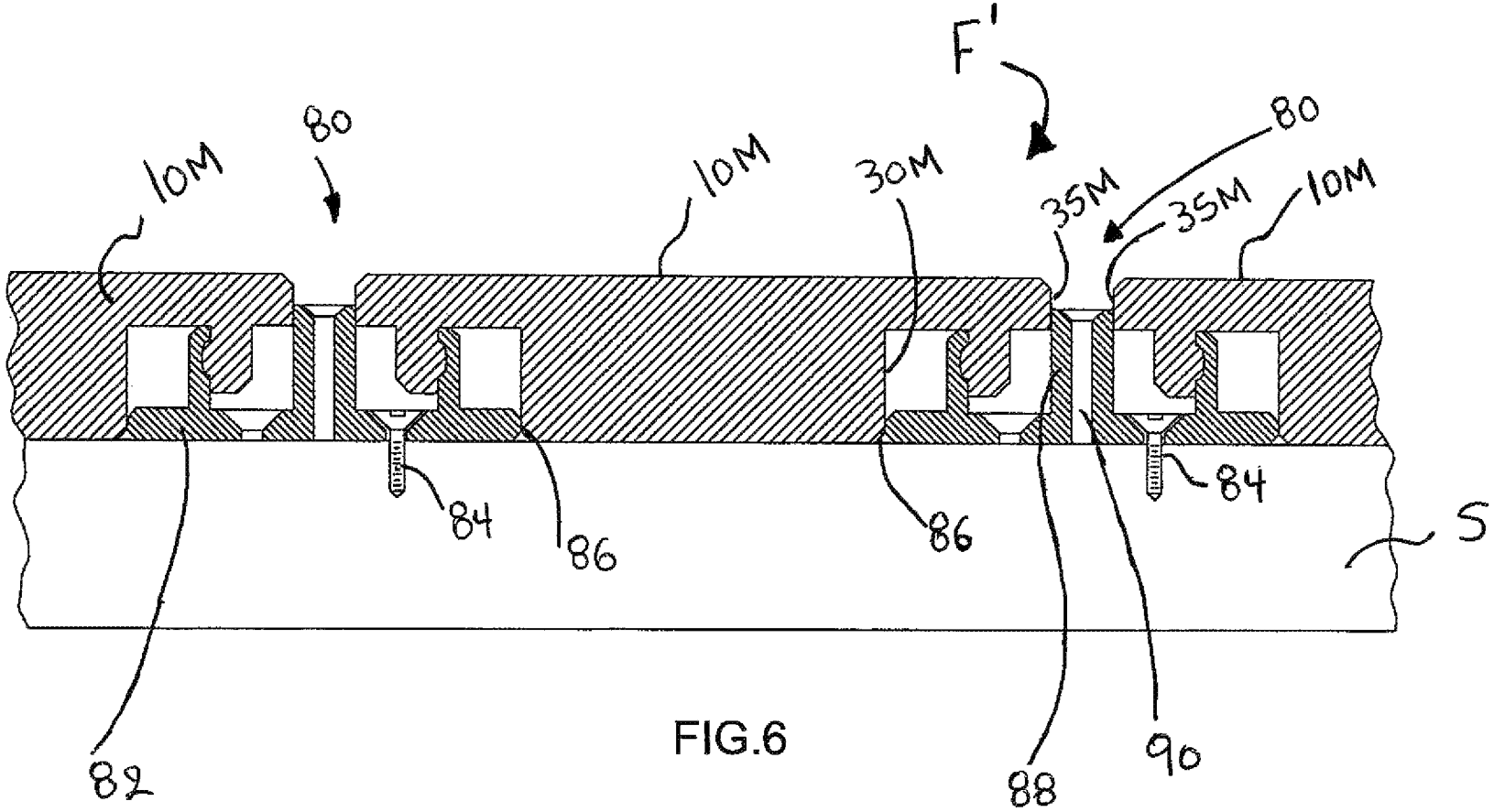
FIG. 6 is front sectional view of an assembled floor covering in accordance with another illustrative non-limiting embodiment of the present disclosure.

The floor covering F includes two types of floorboards 10, namely male floorboards 10M, shown in FIG. 2 and female floorboards 10F, shown in FIG. 3. The side-by-side adjacent floorboards 10 in FIG. 1 are assembled with the floorboards 10 alternating between male floorboards 10M and female floorboards 10F as shown in FIG. 4. The female floorboards 10F are first positioned on the subfloor and the male floorboards 10M are added thereon each lateral side 16M and 18M of the male floorboard 10M engaging and mating with a lateral side 18F and 16F respectively of the female floorboard 10F.

Turning to FIG. 2, the male floorboard 10M includes a wider top section 22M defining an outer surface 24M which defines the exposed surface 12, described above, and a narrower bottom section 26M defining an underside surface 28M for engaging the subfloor.

The lateral sides 16M and 18M of the male floorboard 10M define respective lateral hook structures. More particularly, the narrow section 26M defines lateral side walls 30M flanked by top wing elements 32M extending from each side wall 30M, the wing elements 32M forming part of the wider section 22M. Each wing element 32M defines an underside 34M opposite the exposed outer surface 24M and a lateral end 35M of the top section 22M. A protrusion 36M downwardly extends from the underside 34M to define a groove 38M with the adjacent narrow section side wall 30M and a portion of the underside 34M positioned between the side wall 30M and the protrusion 36M. Each wing element 32M defines a shoulder portion 40M extending laterally beyond the lateral position of the protrusion 36M.

With reference to FIGS. 2 and 4, the narrow section side wall 30M includes a notch 42M near the underside 34M. The protrusion 36M includes an inner wall 44M interfacing with the side wall 30M having a notch 46M. The protrusion 36M further includes a free end surface 48M and an outer wall 50M opposite the inner wall 44M. The free end surface 48M and the outer wall 50M define a curved corner surface 52M therebetween. The exposed surface 24M and each lateral side 35M define a curved corner surface 54M therebetween. The underside surface 34M and the adjacent lateral side 35M define a curved corner surface 56M therebetween. The underside outer surface 28M and the lateral side 30M define a curved corner 58M therebetween.

Turning to FIG. 3, the female floorboard includes shows a floorboard 10F includes a wider bottom section 22F defining an underside surface 24F for engaging the subfloor, and a narrower bottom section 26F defining the underside surface 12 described above.

The lateral sides 16F and 18F of the female floorboard 10F define respective lateral hook structures. More particularly and similarly to the male floorboard 10M, female floorboard 10F also defines a narrow section 26F defining lateral side walls 30F flanked by bottom wing elements 32F extending from each side wall 30F, the wing elements 32F forming part of the wider section 22F. Each wing element 32F defines a floor 34F opposite the underside surface 24F and a lateral end 35F of the bottom section 22F. A protrusion 36F upwardly extends from the floor 34F to define a groove 38F with the adjacent narrow section side wall 30F and the floor portion 34F positioned between the side wall 30F and the protrusion 36F. Each wing element 32F defines a shoulder portion 40F extending laterally beyond the lateral position of the protrusion 36F.

With reference to FIGS. 3 and 4, the narrow section side wall 30F includes a lip 43F. The protrusion 36F includes an inner wall 44F interfacing with the side wall 30M having a lip 47F which matingly corresponds to notch 46F and which is positioned near its free end surface 48F and includes an opposite outer wall 50F. The free end surface 48F and the outer wall 50F define a curved corner surface 52F therebetween. The underside surface 24F and each lateral side 35F define a curved corner surface 54F therebetween. The floor 34F and the adjacent lateral side 35F define a curved corner surface 56F therebetween. The exposed surface 28F and the lateral side 30F define a curved corner 58F therebetween.

When assembling the floor F and as shown in FIG. 4, a given female floorboard 10F is positioned on the subfloor and fastened thereto via driving a fastener through its floor 34F. A male floorboard 10M is positioned on one lateral side 16F of the female floorboard 10F and another male floorboard 10M is positioned on the other lateral side 18F of the female floorboard 10F. As shown, the protrusion 36M of the male floorboard 10M is inserted in groove 38F of the female floorboard 10F and the protrusion 36F being positioned within the groove 38M. The protrusions 36M and 36F mate with the notch 46M receiving the lip 47F.

When assembled, the contiguous exposed surfaces 24M and 28F include a small canal 60 therebetween formed by the curved corners 54M and 58F. Similarly, the contiguous underside surfaces 28M and 24F include a small canal 62 therebetween formed by the curved corners 58M and 54F.

When a given floorboard 10M or 10F is damaged and needs to be removed on order to be replaced, the user simply breaks the wing elements 32M and lifts the floorboard 10M, the floorboard 10F directly underneath the removed floorboard 10M can be unfastened and likewise removed if the two adjacent floorboards 10M have been removed from engagement with this floorboard 10F It should be noted that the position of the floorboards 10M and 10F can be reversed and the indication "male" and "female" is only for convenience and not limitation.

Turning now to FIG. 5, the ends 14 and 15 of the floorboards 10 will be now be described. The first end 14 is provided in form of a staircase structure, defining three steps, 64, 66, and 68, with the second step 66 including a notch 70. The second end 15 is provided in the form of a reverse staircase structure, defining three reverse steps 72, 74 and 76 which correspondingly and respectively mate with the complementary configuration of the three steps 64, 66 and 68. The second step 74 includes a lip 78 which is configured to mate with notch 70.

Turning now to FIG. 5, there is shown another floor covering F' that includes only floorboards 10F and clip elements 80.

Each clip element includes a base 82 that is fastened to the subfloor S via fasteners 84. The base 82 defines lateral ends 86 that are rounded off or curved or convex and that mate with the side walls 30F of the floorboards 10F. A middle portion 88 upwardly extends from the base 82 and is sandwiched by the lateral sides 35M of the two adjacent floorboards 10F and fastened to the subfloor S via a fastener 90. A pair of protrusions 92 upwardly extend from the base 82; each protrusion 92 being positioned at opposite lateral sides of the middle portion 88. Each protrusion 92 includes a notch 94 for receiving the lip 47F. In another embodiment, the protrusions 92 may include a lip (not shown) for being received by the notch 46M of the floorboards 10M.

Figure 7:
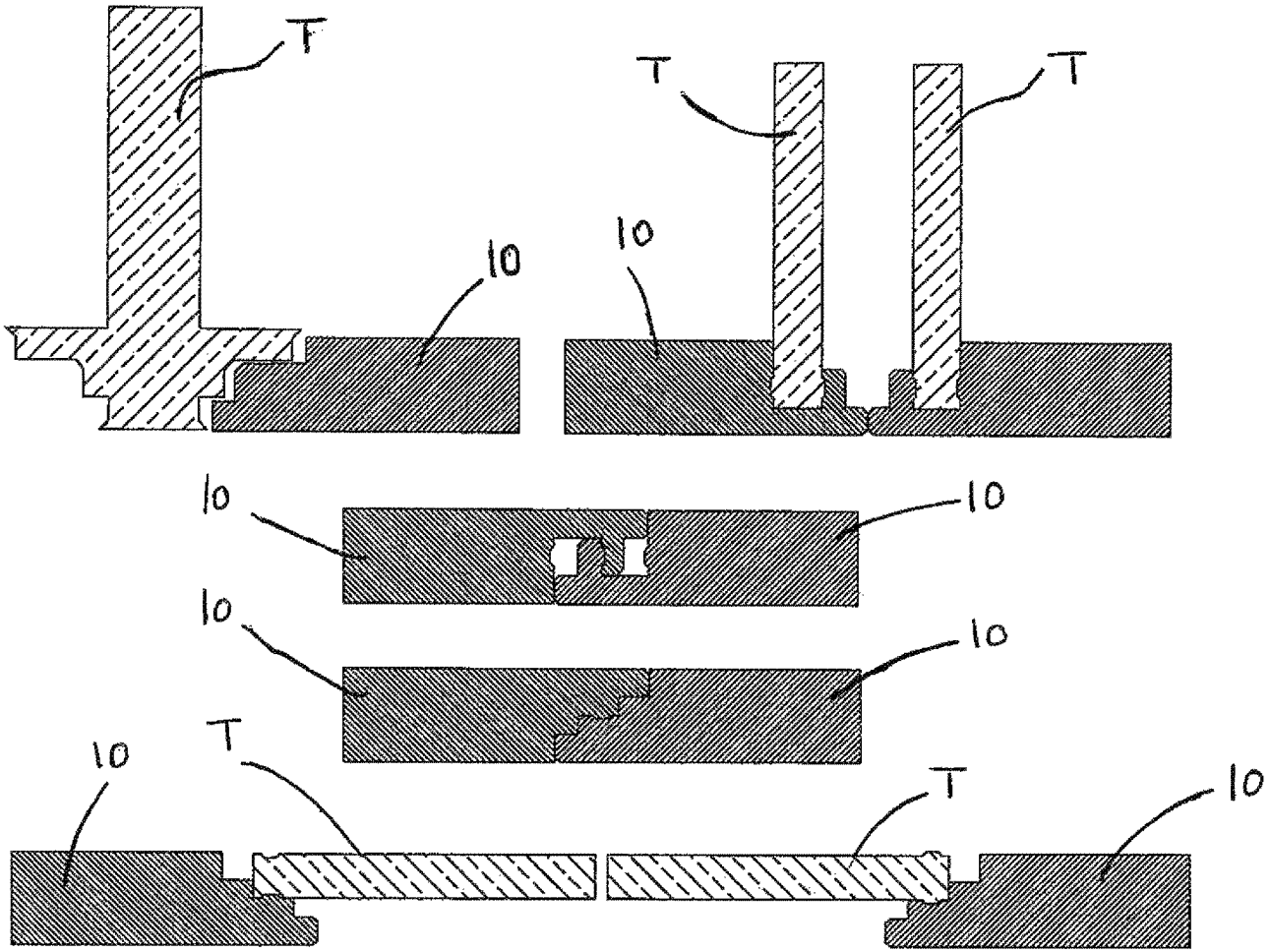
FIG. 7 is a schematic representation of tools forming the ends and lateral sides of the floorboards of the present disclosure in accordance with an illustrative non-limiting embodiment of the present disclosure.

FIG. 7 shows a variety of tools, generally denoted T for forming the configurations of the ends 14 and 15 and sides 16 and 18 described herein.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A floor covering comprising:

at least a first floorboard defining opposite longitudinal ends, an exposed outer surface and an opposite underside surface for engaging a subfloor, the first floorboard comprising mating structures at each lateral side thereof; and at least a second floorboard defining opposite longitudinal ends, an exposed outer surface and an opposite underside surface for engaging a subfloor, the second floorboard comprising mating structures at each lateral side thereof, wherein the first and second floorboards are configured to be adjacently assembled in a side-to-side arrangement with the mating structure of one of the lateral sides of the first floorboard vertically and removably mating with the mating structure of one of the lateral sides of the second floorboard, each of the first and second floorboards comprising a respective first longitudinal end provided in form of a staircase structure, defining three steps, with a second step including a notch, each of the first and second floorboards comprising a respective second longitudinal end provided in form of a reverse staircase structure, defining three reverse steps which correspondingly and respectively mate with the complementary configuration of the three steps of the first end, the second step of the second end comprising a lip configured to mate with the notch, wherein the mating structures of the first floorboard comprises a pair of lateral hook structures and a narrow section therebetween defining the underside surface for engaging the subfloor, the lateral hook structures comprising respective wing elements respectively flanking each side wall, each wing element defining a respective underside and comprising a protrusion downwardly extending from the wing element underside so as to define a groove;

wherein the narrow section comprises lateral side walls;

wherein each wing element defines a shoulder portion extending along the outer surface of the first floorboard away from the protrusion in a direction opposite a direction of the narrow section.

2. A floor covering according to claim 1, wherein one of the first and second floorboards is fastened to the subfloor.

3. A floor covering according to claim 1, wherein the protrusion comprises a free end surface and an outer wall opposite an inner wall interfacing and defining a notch.

4. A floor covering according to claim 1, wherein each of the narrow section side wall comprises a notch.

5. A kit for making a floorboard comprising the floor covering of claim 1, wherein the floor covering is unassembled.

6. A floor covering comprising:

at least a first floorboard defining opposite longitudinal ends, an exposed outer surface and an opposite underside surface for engaging a subfloor, the first floorboard comprising mating structures at each lateral side thereof; and at least a second floorboard defining opposite longitudinal ends, an exposed outer surface and an opposite underside surface for engaging a subfloor, the second floorboard comprising mating structures at each lateral side thereof, wherein the first and second floorboards are configured to be adjacently assembled in a side-to-side arrangement with the mating structure of one of the lateral sides of the first floorboard vertically and removably mating with the mating structure of one of the lateral sides of the second floorboard, each of the first and second floorboards comprising a respective first longitudinal end provided in form of a staircase structure, defining three steps, with a second step including a notch, each of the first and second floorboards comprising a respective second longitudinal end provided in form of a reverse staircase structure, defining three reverse steps which correspondingly and respectively mate with the complementary configuration of the three steps of the first end, the second step of the second end comprising a lip configured to mate with the notch, wherein the mating structures of the second floorboard comprises a pair of lateral hook structures and a narrow section therebetween defining the exposed outer surface, wherein the narrow section comprises lateral side walls and the hook structures comprise respective wing elements respectively flanking each side wall, each wing element defining a respective floor and comprising a protrusion upwardly extending from the wing element underside so as to define a groove with the narrow section side wall, wherein each wing element defines a shoulder portion extending along the outer surface of the second floorboard away from the protrusion in a direction opposite a direction of the narrow section.

7. A floor covering according to claim 6, wherein the protrusion comprises a free end surface and an outer wall opposite an inner wall interfacing and defining a lip to be received by a notch.

8. A floor covering according to claim 6, wherein each of the narrow section side wall comprises a notch.

* * * * *